US010012205B2

(12) United States Patent
Campagna et al.

(10) Patent No.: US 10,012,205 B2
(45) Date of Patent: Jul. 3, 2018

(54) GAS FUEL ENGINE SPARK PLUG FAILURE DETECTION

(71) Applicant: Caterpillar Inc., Peoria, IL (US)

(72) Inventors: Michael J. Campagna, Chillicothe, IL (US); David Krenek, Kingwood, TX (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/247,308

(22) Filed: Aug. 25, 2016

(65) Prior Publication Data

US 2018/0058416 A1 Mar. 1, 2018

(51) Int. Cl.

*F02P 17/12* (2006.01)
*F02P 11/06* (2006.01)
*F02B 77/08* (2006.01)

(52) U.S. Cl.

CPC ..... *F02P 17/12* (2013.01); *F02B 77/086* (2013.01); *F02P 11/06* (2013.01); *F02P 2017/121* (2013.01)

(58) Field of Classification Search

CPC ..... F02P 17/12; F02P 11/06; F02P 2017/121; F02B 77/086

See application file for complete search history.

(56) References Cited

U.S. PATENT DOCUMENTS 5,418,461 A 5/1995 Maeda et al.
5,438,970 A 8/1995 Maruyama et al.
6,321,531 B1 * 11/2001 Caren ..... B01D 53/90 204/168
6,492,818 B1 12/2002 Cummins
6,559,647 B1 * 5/2003 Bidner ..... F02P 15/02 123/310
7,137,385 B2 * 11/2006 Newton ..... F02P 3/045 123/630
9,470,202 B2 * 10/2016 Torrisi ..... F02P 9/00
9,683,535 B2 * 6/2017 Glugla ..... F02P 17/12
2004/0084035 A1 * 5/2004 Newton ..... F02P 3/045 123/630
2006/0217872 A1 * 9/2006 Moriya ..... F02D 41/1497 701/114

(Continued)

FOREIGN PATENT DOCUMENTS

DE 102011005651 A1 9/2012
DE 102012010177 A1 11/2012

(Continued)

*Primary Examiner* — Joseph Dallo
(74) *Attorney, Agent, or Firm* — Miller, Matthias & Hull

(57) ABSTRACT

A system for detecting spark plug failures in an engine is provided. The system may include one or more sensor devices coupled to the engine and configured to measure engine data, a controller in communication with the sensor devices, and an output device. The controller may be configured to determine at least a misfire count, a secondary transformer voltage, and an exhaust port temperature based on the engine data, identify a fault condition based on one or more of the misfire count, the secondary transformer voltage, and the exhaust port temperature, and perform a corrective action responsive to the fault condition. The output device may be configured to generate a notification corresponding to the fault condition.

16 Claims, 5 Drawing Sheets

(56) References Cited

U.S. PATENT DOCUMENTS

| | | | | |
|---|---|---|---|---|
| 2008/0295487 | A1* | 12/2008 | Binder | F01N 9/005 60/274 |
| 2010/0286891 | A1* | 11/2010 | Huang | G01M 15/11 701/102 |
| 2011/0202260 | A1* | 8/2011 | Cunningham | F02D 35/02 701/104 |
| 2013/0340512 | A1* | 12/2013 | Horlbeck | F02D 41/1497 73/114.02 |
| 2014/0020655 | A1* | 1/2014 | Ito | F02D 41/22 123/339.1 |
| 2014/0188369 | A1* | 7/2014 | Torrisi | F02P 9/00 701/102 |
| 2015/0340846 | A1 | 11/2015 | Schultz et al. | |
| 2017/0002786 | A1* | 1/2017 | Glugla | F02P 17/12 |

FOREIGN PATENT DOCUMENTS

| | | | |
|---|---|---|---|
| JP | 2011127562 | A | 6/2011 |
| WO | 2011023852 | A1 | 3/2011 |

* cited by examiner

GAS FUEL ENGINE SPARK PLUG FAILURE DETECTION

TECHNICAL FIELD

The present disclosure relates generally to ignition systems for gas fueled engines, and more particularly, to systems and methods for monitoring and detecting spark plug failures.

BACKGROUND

Internal combustion engines, or more particularly, gas fueled engines, may be used to power various different types of machines, such as on-highway trucks or vehicles, off-highway machines, earth-moving equipment, generators, aerospace applications, pumps, stationary equipment such as power plants, and the like. In general terms, gas fueled engines are supplied with a mixture of air and fuel, which is ignited at specific timing intervals using spark plugs and ignition systems in order to generate mechanical energy, such as rotational output torque, and ultimately used to drive or operate the associated machine. There are various ongoing efforts to improve the efficiency and reliability of the engine, and the overall productivity of the machine. Periodically monitoring the health of spark plugs is one way to help reduce unplanned downtimes and improve productivity.

The life of a spark plug in an internal combustion engine may be affected by the magnitude of the electrical current that is repeatedly passed across a gap of the spark plug. In particular, the repeated exposure to high electrical current may subject the metal tip of the spark plug to various failures over time. Over time, for instance, a spark plug may be prone failures caused by metal erosion at the tip or near the spark plug gap, delamination at the metal tip, spontaneous detachment of metal at the tip, or the like. When left unaddressed, such failures may result in misfires and other adverse effects which can decrease overall efficiency of the machine or cause engine damage. It is thus helpful to not only be able to track the health of the spark plugs, but also to be able to quickly detect failures when they occur so as to minimize inefficient operation, unplanned downtimes and unnecessary damage.

One currently available means for detecting spark plug failures is disclosed by U.S. Pat. No. 6,559,647 ("Bidner"). Specifically, Bidner discloses a method which temporarily disables one of the spark plugs in each cylinder of the engine during a designated test period, in order to determine whether a misfire occurs. Based on whether a misfire occurs, Bidner is able to confirm proper functionality of each spark plug. Although Bidner may be effective, it can become quite tedious to disable each spark plug for each cylinder of each engine, and it can also be quite time consuming to complete each test routine. Furthermore, because the test routine in Bidner cannot be performed on the fly or during normal engine or machine operations, the total amount of downtime set aside and spent on running such tests throughout the life of the machine can be substantial.

In view of the foregoing disadvantages associated with conventional spark plug monitoring techniques, a need exists for a solution which, not only effectively monitors for spark plug failures, but also does so passively, without interrupting productivity and without requiring any significant downtime. Moreover, there is a need for a spark plug monitoring technique that is capable of employing readily available data and information, such as from an engine control or management unit, and using that information to identify the health or any existing failures in the spark plugs. The present disclosure is directed at addressing one or more of the deficiencies and disadvantages set forth above. However, it should be appreciated that the solution of any particular problem is not a limitation on the scope of this disclosure or of the attached claims except to the extent expressly noted.

SUMMARY OF THE DISCLOSURE

In one aspect of the present disclosure, a system for detecting spark plug failures in an engine is provided. The system may include one or more sensor devices coupled to the engine and configured to measure engine data, a controller in communication with the sensor devices, and an output device. The controller may be configured to determine at least a misfire count, a secondary transformer voltage, and an exhaust port temperature based on the engine data, identify a fault condition based on one or more of the misfire count, the secondary transformer voltage, and the exhaust port temperature, and perform a corrective action responsive to the fault condition. The output device may be configured to generate a notification corresponding to the fault condition.

In another aspect of the present disclosure, a controller for detecting spark plug failures in an engine is provided. The controller may include a sensor module, a calculation module, a fault detection module, and a correction module. The sensor module may be configured to receive engine data from one or more sensor devices of the engine. The calculation module may be configured to determine at least a misfire count, a secondary transformer voltage, and an exhaust port temperature based on the engine data. The fault detection module may be configured to identify a fault condition based on one or more of the misfire count, the secondary transformer voltage, and the exhaust port temperature. The correction module may be configured to perform a corrective action responsive to the fault condition.

In yet another aspect of the present disclosure, a method of detecting spark plug failures in an engine is provided. The method may include receiving engine data from one or more sensor devices of the engine, determining at least a misfire count, a secondary transformer voltage, and an exhaust port temperature based on the engine data, identifying a fault condition based on one or more of the misfire count, the secondary transformer voltage, and the exhaust port temperature, and performing a corrective action responsive to the fault condition.

These and other aspects and features will be more readily understood when reading the following detailed description in conjunction with the accompanying drawings.

While the following detailed description is given with respect to certain illustrative embodiments, it is to be understood that such embodiments are not to be construed as limiting, but rather the present disclosure is entitled to a scope of protection consistent with all embodiments, modifications, alternative constructions, and equivalents thereto.

DETAILED DESCRIPTION

Figure 1:
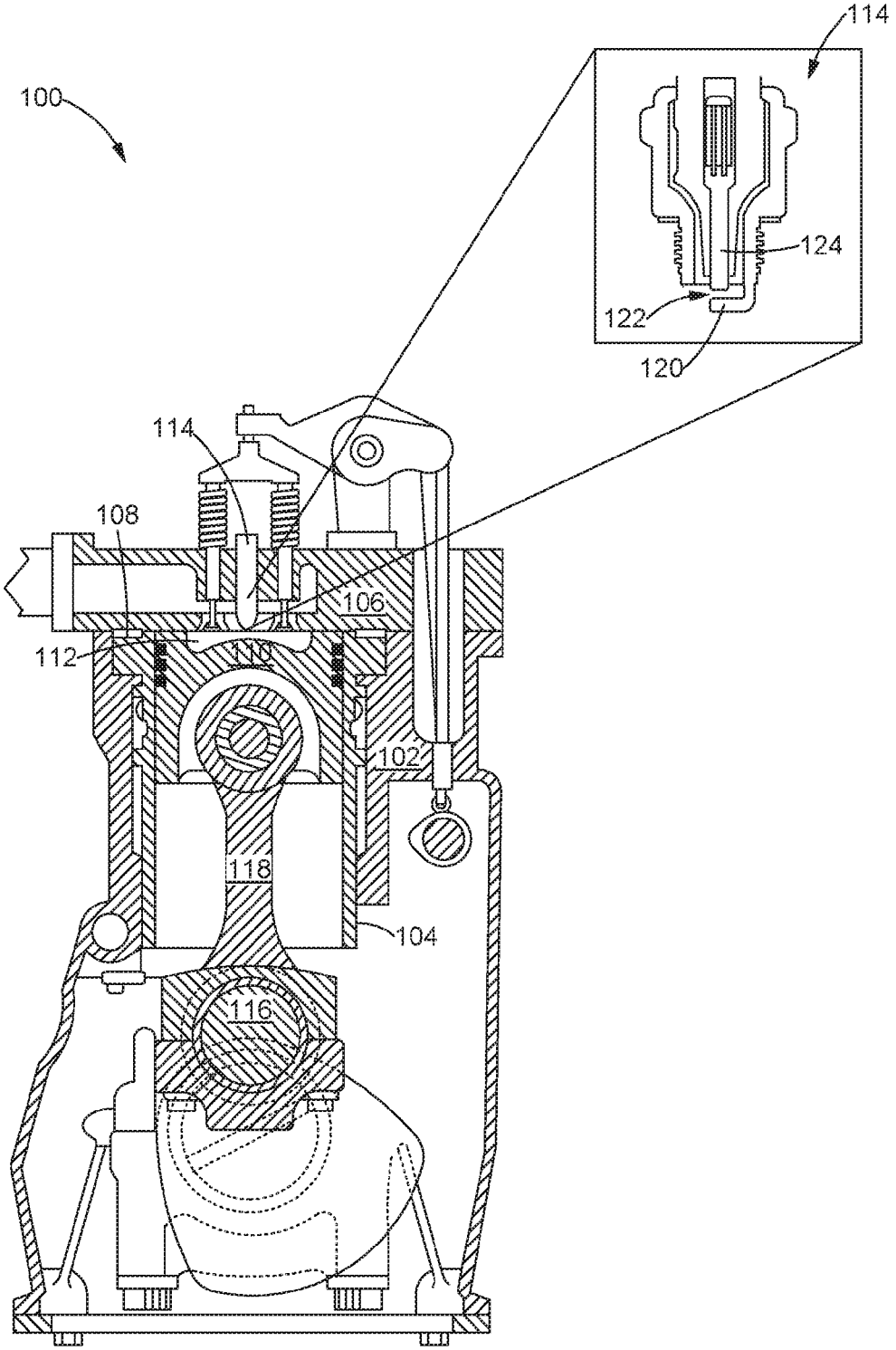
FIG. 1 is a partial cross-sectional view of a combustion chamber and spark plug of a typical engine.

Referring to FIG. 1, a section of one exemplary internal combustion engine 100 is provided. Although the engine 100 shown may be used in a variety of different applications, the engine 100 and embodiments shown may be incorporated into machines, such as earth-moving machines or stationary work machines. For example, the engine 100 may be used to operate on-highway trucks, off-highway machines, earth-moving equipment, generators, aerospace applications, pumps, stationary equipment such as power plants, and the like. Additionally, the engine 100 may include any suitable internal combustion engine that uses air and fuel mixtures to generate mechanical power, such as rotational torque output, or the like. For example, the engine 100 may include a gasoline engine, a natural gas engine, or any other suitable internal combustion engine which employs spark plugs and related ignition systems for combustion.

As shown in FIG. 1, the engine 100 may include a block 102 defining one or more bores 104 which are substantially sealed using a head 106 and corresponding gasket 108. The engine 100 may also include a piston 110 slidably disposed within each bore 104 which defines a combustion chamber 112 with the head 106 and gasket 108. Furthermore, each combustion chamber 112 of the engine 100 may include one or more spark plugs 114 that are coupled to the head 106 and at least partially introduced into the combustion chamber 112. It will be understood that the engine 100 may include any number of combustion chambers 112 and that the combustion chambers 112 may be arranged in any number of different configurations, such as in an "in-line" configuration, in a "V" configuration, in an opposing-piston configuration, or the like.

The piston 110 in FIG. 1 may be configured to linearly reciprocate within the bore 104 between fully extended and fully retracted positions during a combustion event. For example, the piston 110 may be pivotally connected to a crankshaft 116 by way of a connecting rod 118 such that linear movement of the piston 110 between the fully extended and fully retracted positions causes the crankshaft 116 to rotate, and such that rotation of the crankshaft 116 causes the piston 110 to slide within the bore 104. Furthermore, during a combustion event, the piston 110 may be designed to travel through a plurality of strokes, including an intake stroke, a compression stroke, a power stroke, and an exhaust stroke. For example, fuel may be injected into the combustion chamber 112 during the intake stroke, and mixed with air and ignited during the compression stroke. The resulting heat and pressure may then be converted into mechanical power during the power stroke, and residual gases may be discharged from the chamber 112 during the exhaust stroke.

As further shown in FIG. 1, the spark plug 114 may be installed into the head 106 in a manner which introduces a metal tip 120 of the spark plug 114 into the combustion chamber 112. The metal tip 120 may be composed of an electrode which forms a gap 122 with a counterpart electrode 124 such that application of a voltage difference across the metal tip 120 and the electrode 124 creates an electrical arc or spark therebetween. With proper timing, this spark can be used to ignite the air and fuel mixtures within the combustion chamber 112, such as during the compression stroke. Over time, the high levels of voltage and current that are repeatedly applied across the gap 122 may potentially subject the metal tip 120 of the spark plug 114 to different types of failures, such as metal erosion, delamination, or spontaneous detachment at the metal tip 120 or near the gap 122 of the spark plug 114. Such failures may in turn may cause misfires and other adverse effects.

Figure 2:
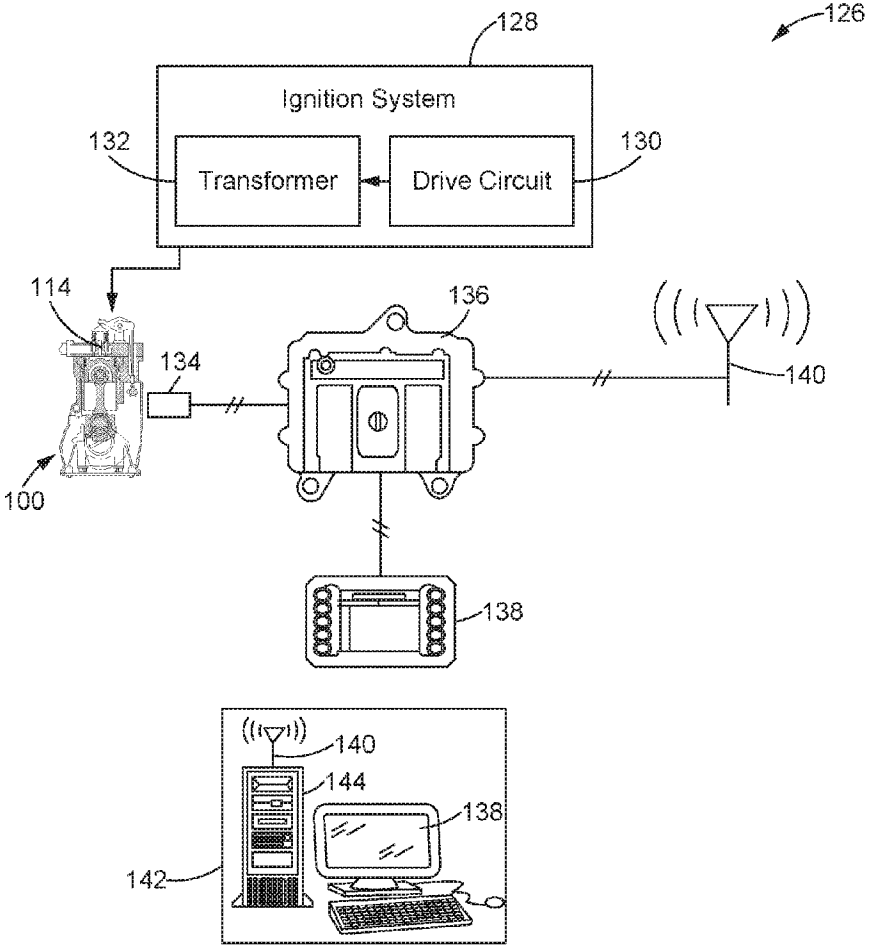
FIG. 2 is a diagrammatic view of one exemplary embodiment of a fault detection system of the present disclosure.

Turning to FIG. 2, one exemplary embodiment of a fault detection system 126 which may be used to monitor and detect such spark plug failures is diagrammatically provided. As shown, the fault detection system 126 may be implemented in relation to the engine 100 and an ignition system 128 associated therewith. As commonly understood in the art, the ignition system 128 may include one or more drive circuits 130 configured to control the magnitude and frequency of the voltage applied to the spark plug 114 as well as the timing of the ignition. The ignition system 128 may also include one or more ignition coils or transformers 132 configured to receive electrical signals from the drive circuits 130, such as at a primary winding, and to convert the electrical signals into appropriate voltage signals, such as at a secondary winding, for operating the spark plug 114. Moreover, the secondary transformer voltage, or the voltage supplied by the secondary winding of the transformer 132, may be used to generate the arc or spark at the metal tip 120 of the spark plug 114.

As shown in FIG. 2, the fault detection system 126 may include at least one or more sensor devices 134 and a controller 136 in communication with the one or more sensor devices 134. The sensor devices 134 may be coupled to the engine 100 and configured to measure various engine data, such as one or more of engine speed, engine oil temperature, turbine inlet temperature, turbine exhaust temperature, misfire count, secondary transformer voltage, exhaust port temperature, in-cylinder pressure, and any other information relevant to monitoring the health of the spark plugs 114. Moreover, any one or more of the sensor devices 134 may be preexisting and already integrated in the engine 100 and/or an engine management or control unit associated therewith. In addition, the controller 136 may be separately provided or at least partially integrated within the engine management or control unit, and configured to electrically communicate with the one or more sensor devices 134.

The sensor devices 134 of FIG. 2 may be configured to generate signals indicative of parameter values or engine data associated with the combustion process occurring inside the engine 100. It will be understood that any one or more of the sensor devices 134 may also embody virtual sensors rather than physical sensors, for example, configured to produce an algorithm-driven estimated value based on one or more other known or measured values. For example, based on a known or measured operating speed, fuel quantity, injection timing, fuel pressure, air flow rate, air temperature, air pressure, coolant temperature, or other engine data, reference may be made to predefined models, maps, lookup tables and/or equations to estimate or derive other operating parameters or data. The value of any signal that is provided by the sensor devices 134 may thus be estimations or derivations rather than direct measurements. In other embodiments, one or more of the virtual sensing functions may be performed within the controller 136 itself.

Still referring to FIG. 2, the fault detection system 126 may additionally include an output or display device 138 and/or a communications device 140. The display device 138 shown may include one or more monitors, such as liquid crystal displays (LCDs), cathode ray tubes (CRTs), personal digital assistants (PDAs), plasma displays, touch-screen displays, portable hand-held devices, or any other suitable display device known in the art configured to provide an operator with indications, notifications or other information pertaining to any existing spark plug failures, fault conditions, related warnings, recommended or necessary corrective actions, and the like. The communications device 140 may employ one or more wired and/or wireless networks which enable the local controller 136 to communicate information pertaining to spark plug health to operators situated at other local controllers 136 and/or one or more remote monitoring stations 142.

Figure 3:
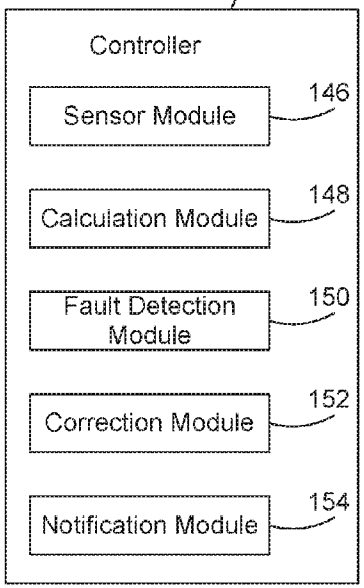
FIG. 3 is a diagrammatic view of one exemplary controller that may be used with a fault detection system of the present disclosure.

Referring now to FIG. 3, one exemplary embodiment of a controller 136 that may be used with the fault detection system 126 is diagrammatically provided. As shown in FIG. 3, and as generally described above with respect to FIG. 2, the controller 136 may be implemented using one or more of a processor, a microprocessor, a microcontroller, an engine control module (ECM), an engine control unit (ECU), and any other suitable device for communicating with any one or more of the sensor devices 134, the output or display device 138, the communications device 140, and the like. The controller 136 may be configured to operate according to predetermined algorithms or sets of logic instructions designed to manage the fault detection system 126, monitor the engine data, and identify any fault conditions of the spark plugs 114 based on comparisons between the engine data and predefined thresholds.

As shown in FIG. 3, the controller 136 may be configured to function according to one or more preprogrammed algorithms, which may be generally categorized into, for example, a sensor module 146, a calculation module 148, a fault detection module 150, a correction module 152, and a notification module 154. The controller 136 may additionally include access to any memory, such as local on-board memory and/or memory remotely situated from the controller 136, for at least temporarily storing any one or more of the algorithms, engine data, predefined thresholds, and other logic instructions. It will be understood that the arrangement of grouped code or logic instructions shown in FIG. 3 merely demonstrates one possible way to implement and perform the functions of the fault detection system 126, and that other comparable arrangements are possible and will be apparent to those of ordinary skill in the art. For instance, other embodiments may modify, merge, omit and/or add to one or more of the modules in FIG. 3 and still provide comparable results.

As shown in FIG. 3, the sensor module 146 of the controller 136 may be configured to receive various engine data from one or more of the sensor devices 134 of the engine 100. The engine data may be specific to individual combustion chambers 112 or universal to the engine 100. For example, the sensor module 146 may be configured to receive, and the sensor devices 134 may be capable of measuring or deriving, engine data corresponding to one or more of engine speed, engine oil temperature, exhaust port temperature, in-cylinder pressure, and if available, turbine inlet and/or exhaust temperature. The sensor module 146 and the sensor devices 134 may additionally be configured to detect misfires or derive information which can be used to identify misfires occurring during operation of the engine 100. The sensor module 146 and the sensor devices 134 may also be able to measure or derive the secondary transformer voltage, or the voltage supplied by the secondary winding of the transformer 132 to the spark plug 114, in a given combustion chamber 112.

Figure 4:
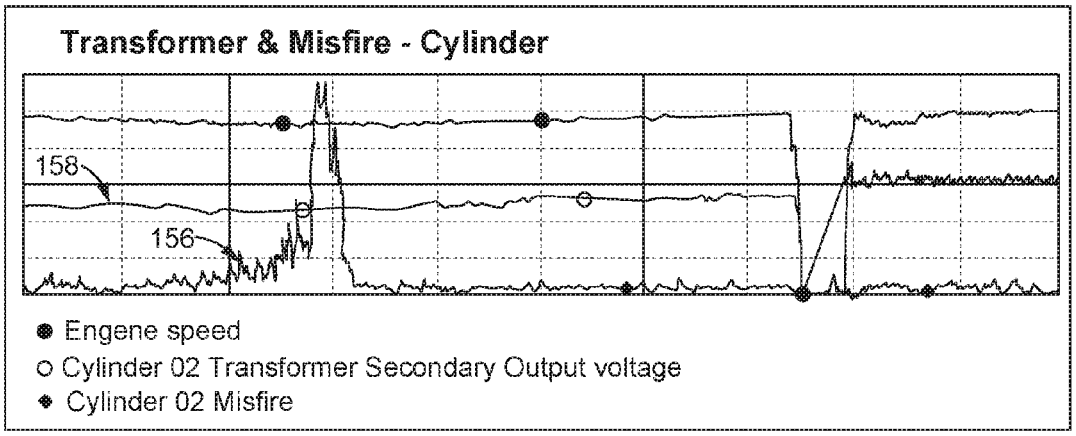
FIG. 4 is a graphical view of exemplary engine data, including engine speed, secondary transformer voltage and misfire information, that may be accessed or derived by the fault detection system of the present disclosure.
Figure 5:
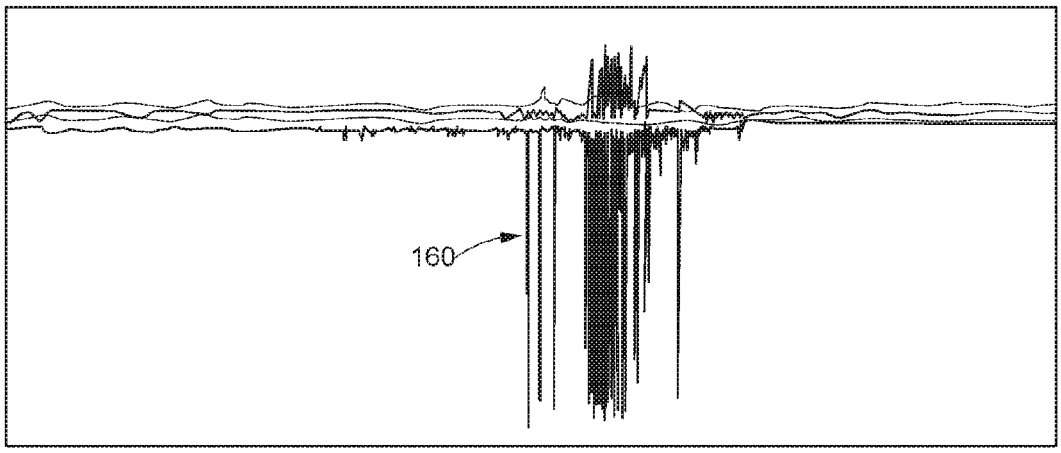
FIG. 5 is a graphical view of exemplary engine data, including exhaust port temperatures, that may be accessed or derived by the fault detection system of the present disclosure.

Based at least partially on the engine data received by the sensor module 146, the calculation module 148 of FIG. 3 may be configured to retrieve, calculate or otherwise determine at least a misfire count value, a secondary transformer voltage, and an exhaust port temperature. For example, based on engine data provided by the sensor module 146, the calculation module 148 may be configured to derive a cylinder misfire signal 156, or the like, indicative of cylinder misfires, and identify or count the number of misfires which have occurred within a given duration based on peaks or dips in the cylinder misfire signal 156 as shown in FIG. 4. Similarly, the calculation module 148 may be configured to monitor a secondary transformer voltage signal 158 representative of the secondary transformer voltage supplied to the spark plug 114 as also shown for example in FIG. 4. Furthermore, the exhaust port temperature or deviations therein may be determined as shown for example by the exhaust port temperature signals 160 in FIG. 5.

In other modifications, the controller 136 of FIG. 3 may be configured to initially verify one or more data trap conditions prior to engaging the sensor module 146 and/or the calculation module 148 to ensure that the engine 100 is sufficiently within normal operating conditions before engine data is sampled or calculated upon. For example, the sensor module 146 and/or the calculation module 148 may be configured to determine the misfire count, the secondary transformer voltage, and the exhaust port temperature once the engine speed has been verified to be greater than or equal to a minimum predefined engine idle speed. Periods associated with start-up and cranking may be excluded from this verification routine. Additionally, the sensor module 146 and/or the calculation module 148 may also be required to first verify that the engine 100 is operating at a minimum predefined engine operating temperature. For example, if the engine operating temperature meets or exceeds the minimum predefined engine operating temperature, the engine 100 may be considered to be in a warm state and under ideal conditions for data acquisition. Otherwise, the engine 100 may considered to be operating in a cold state and not yet ready for data acquisition.

In particular, the sensor module 146 and/or the calculation module 148 in FIG. 3 may derive the minimum predefined engine operating temperature based on engine oil temperatures, coolant temperatures, or any other temperature indicative of whether the engine 100 is operating in a warm state or a cold state. Although engines vary in terms of operating temperature ranges, a given engine 100 for example may be considered to be in a sufficiently warm state if the engine oil temperature is greater than or equal to approximately 45° C. If any one of the data trap conditions have not been satisfied, the controller 136 may continue to receive engine data until such conditions have been verified. If, however, all data trap conditions have been verified, the controller 136 may proceed to perform calculations and other analyses. Although only two data trap conditions are discussed with respect to the controller 136 of FIG. 3, it will be understood that other data trap conditions may be employed for different applications or engine types.

In general, the fault detection module 150 in FIG. 3 may identify a fault condition in the spark plugs 114 based on one or more of the misfire count, the secondary transformer voltage, and the exhaust port temperature determined by the sensor module 146 and/or the calculation module 148. For example, the fault detection module 150 may identify one of an erosion-based fault condition, a delamination-based fault condition, a detachment-based fault condition, and any other relevant fault condition. Prior to classifying the type of fault condition, however, the fault detection module 150 may first determine whether the sum of detected misfires exceeds a minimum misfire count threshold. In one example, if the misfire count indicates approximately 55 or more detected misfires within a 30-minute duration, the fault detection module 150 confirm a fault condition exists and proceed to classify the specific fault condition. Otherwise, the fault detection module 150 may deem that a fault condition does not yet exist and continue monitoring the spark plugs 114.

If the misfire count indicates a sufficient frequency and occurrence of misfires deserving further investigation, the fault detection module 150 of FIG. 3 may additionally identify the specific type of fault condition that is present based on certain characteristics of the secondary transformer voltage. To identify the erosion-based fault condition, for instance, the fault detection module 150 may determine whether the secondary transformer voltage remains greater than an upper voltage threshold for a predefined duration. For example, if the secondary transformer voltage, or signal 158 of FIG. 4, is approximately 95% or more of its maximum value for 5 seconds or longer, or approximately 99% or more for 2 seconds or longer, the fault detection module 150 may identify the fault condition as an erosion-based fault condition. In other embodiments, the fault detection module 150 may employ other voltage thresholds and/or other durational thresholds for identifying the erosion-based fault condition. Alternative combinations of thresholds, limits or criteria may be used for different engine types, hardware and configurations, and will be apparent to those of skill in the art.

Alternatively, to identify the delamination-based fault condition, the fault detection module 150 of FIG. 3 may be configured to determine whether the secondary transformer voltage remains less than a lower voltage threshold for a predefined duration. For instance, if the secondary transformer voltage, or signal 158 of FIG. 4, is approximately 45% or less of its maximum value for 3 seconds or longer, the fault detection module 150 may identify the fault condition as a delamination-based fault condition. In other variants, the fault detection module 150 may be configured to employ other secondary transformer voltage values or thresholds and/or other durational thresholds for identifying the delamination-based fault condition. For instance, different combinations of thresholds, limits or criteria may be used for different engine types, hardware and configurations, and will be apparent to those of ordinary skill in the art.

Figure 6:
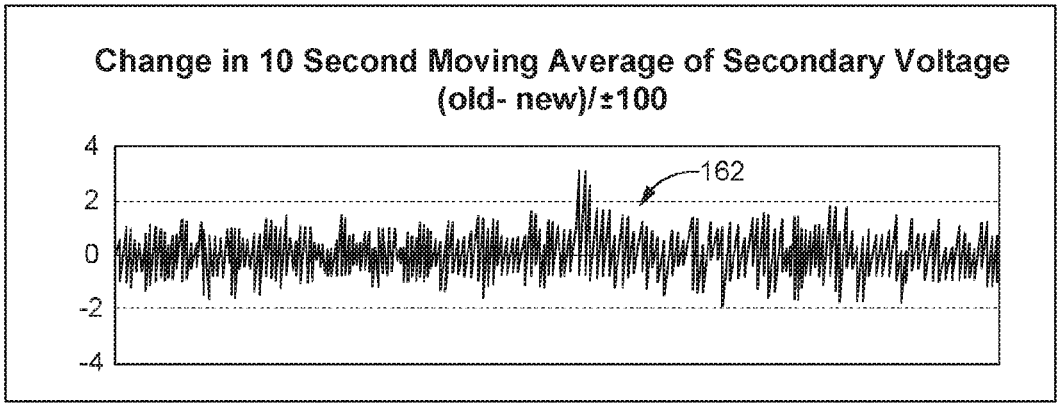
FIG. 6 is a graphical view of exemplary engine data, including the rate of change of secondary transformer voltage with respect to time, that may be accessed or derived by the fault detection system of the present disclosure.

Still further, in order to identify the detachment-based fault condition, the fault detection module 150 of FIG. 3 may be configured to determine whether the rate of change of the secondary transformer voltage with respect to time exceeds a moving average voltage threshold within a given timeframe. In one example, if the rate of change of the secondary transformer voltage, such as shown in the derivative voltage signal 162 of FIG. 6, exceeds approximately 2.5 V/s within a 10-second period, a detachment-based fault condition may be identified. In other embodiments, the fault detection module 150 may be configured to monitor for other rates of change in the secondary transformer voltage and/or other durational thresholds for identifying the detachment-based fault condition. For instance, different combinations of thresholds, limits or criteria may be used for different engine types, hardware and configurations, and will be apparent to those of ordinary skill in the art.

Still referring to the controller 136 of FIG. 3, the correction module 152 may perform a corrective action that is responsive to the identified fault condition. The appropriate corrective action may be selected based on deviations between the exhaust port temperature of the faulty cylinder and the bank average, or the average of the exhaust port temperatures of the other cylinders in the engine 100, as illustrated for example in FIG. 5. For instance, if the exhaust port temperature of the faulty cylinder remains within approximately 60° C. of the bank average during a one-hour period, the fault condition may be deemed less urgent and the corrective action may indicate an advisory warning to operators suggesting replacement of the failed spark plug 114 at the next stop or the next available opportunity. For other engine types, hardware or configurations, the correction module 152 may monitor for other types of criteria, such as other temperature thresholds and/or other durational limits, prior to indicating or generating the advisory warning.

If, however, the temperature deviation determined by the correction module 152 of FIG. 3 is in excess of approximately 60° C. during a one-hour period, the fault condition may be considered more urgent and the corrective action may be to immediately stop the engine 100 and indicate a critical warning to operators suggesting immediate replacement of the failed spark plug 114. It will be understood that the correction module 152 may be modified to employ other combinations of temperature thresholds, durational limits, and/or other criteria for other engine types, hardware, configurations and application, and still provide comparable results. For example, other engine types, hardware or configuration may demand that the correction module 152 monitors for other types of criteria, such as other temperature thresholds and/or other durational limits, prior to classifying the fault condition as urgent and prior to indicating the critical warning.

In addition, the controller 136 of FIG. 3 may also include a notification module 154 configured to display a notification corresponding to the fault condition to an operator. For example, if a fault condition has been identified, the notification module 154 may be configured to generate and display a notification of the identified fault condition through any one or more of the local and remote output or display devices 138 shown in FIG. 2. Additionally or optionally, if a corrective action is necessary or has already been taken, the notification module 154 may also be configured to generate and display additional notifications of such corrective actions for the operator. In other embodiments, the notification module 154 may further enable an operator to record, update, forward, or respond to such notifications through an interface of the output or display devices 138.

Furthermore, the controller 136 of FIG. 3 may be configured to reiteratively perform any one or more of the preceding tasks or processes associated with monitoring engine data and/or comparing engine data to predefined thresholds at a frequency sufficient to characterize the health or any failures of the spark plugs 114. In one possible implementation, the sampling frequency may be designated to be as fast as one crank angle, such as approximately 18 kHz for industrial work machine applications or approximately 50 kHz for automobile or other applications. In terms of the operations of the controller 136, the algorithms described above may be configured to operate at a rate of approximately 1 Hz or approximately once a minute with the engine data being received in streaming formats, in continuous feed formats, in batch formats, or any combination thereof. It will be understood that other suitable sampling or data processing frequencies may also be used for various other applications and still provide comparable results. For instance, different sampling rates or reiterative frequencies may be used for different engine types, hardware and configurations, and will be apparent to those of ordinary skill in the art.

INDUSTRIAL APPLICABILITY

In general, the present disclosure finds utility in various applications, such as on-highway trucks or vehicles, off-highway machines, earth-moving equipment, generators, aerospace applications, pumps, stationary equipment such as power plants, and the like, and more particularly, provides a non-intrusive and efficient technique for monitoring the health of ignition systems. Specifically, the present disclosure provides methods and systems that are capable of employing preexisting sensors and data to not only detect a spark plug failure, but also to identify the specific fault condition and the corrective actions for resolving the particular fault identified. By allowing use of existing hardware, the present disclosure reduces costs of implementation. Also, by allowing the fault detection system to operate in tandem with normal engine operations, the present disclosure substantially reduces both planned and unplanned downtimes previously dedicated to spark plug repairs and maintenance.

Figure 7:
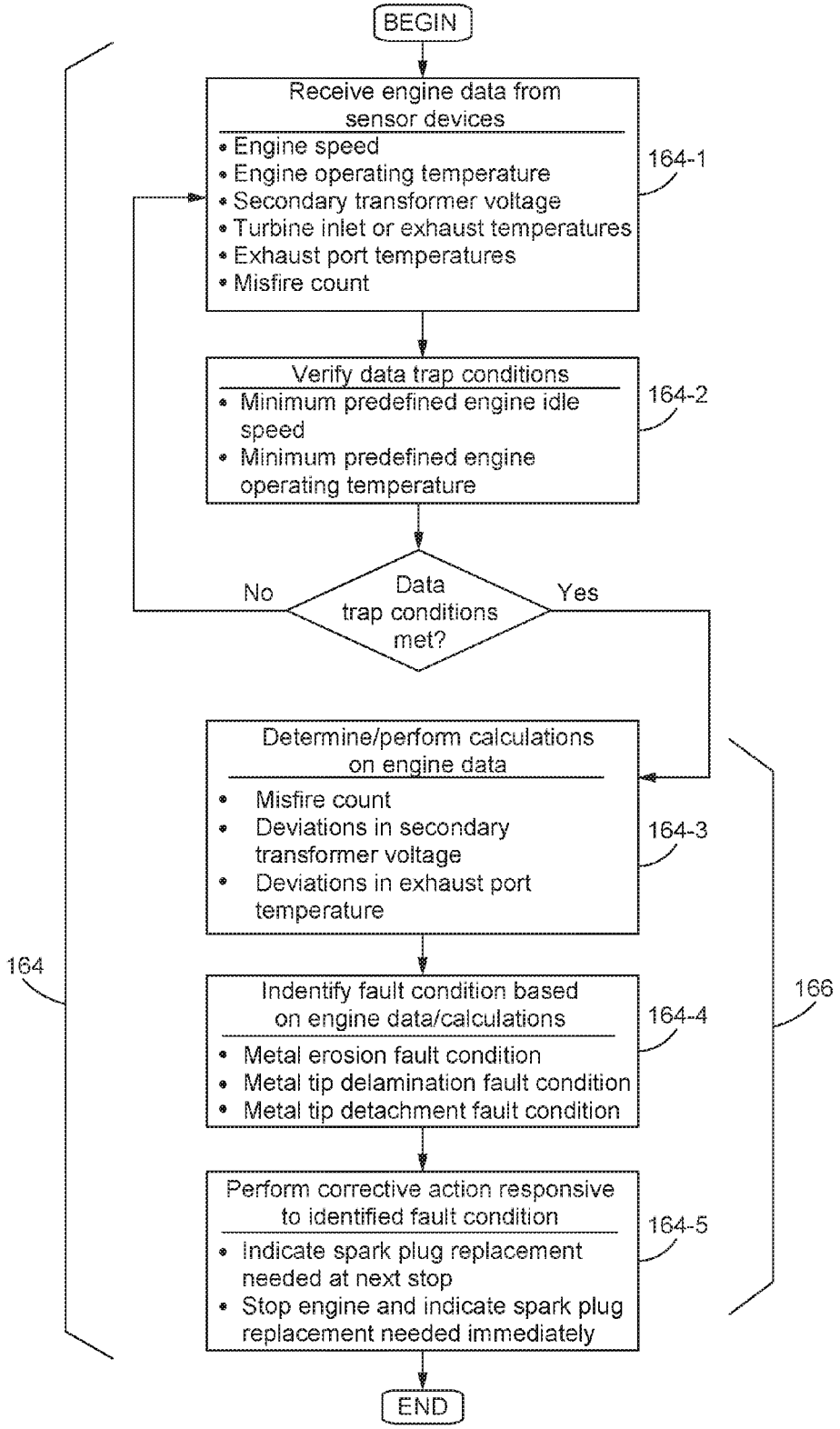
FIG. 7 is a flow diagram of one exemplary algorithm or method of detecting spark plug failures in an engine.

Turning to FIG. 7, one exemplary algorithm or method 164 of detecting failures in spark plug 114 and for controlling the fault detection system 126 of FIG. 2 is provided. In particular, the method 164 may be implemented in the form of one or more algorithms, instructions, logic operations, or the like, and the individual processes thereof may be performed or initiated via the controller 136. As shown in block 164-1, the method 164 may initially receive engine data from one or more of the sensor devices 134 associated with the engine 100. The engine data may include, for example, one or more of engine speed, engine oil temperature, exhaust port temperature, in-cylinder pressure, and if available, turbine inlet and/or exhaust temperature. The method 164 may additionally receive engine data corresponding to the number of detected misfires or a misfire count value, and the secondary transformer voltage supplied by the secondary winding of the transformer 132 to a given spark plug 114.

Before performing calculations or other analyses on the engine data, the method 164 in block 164-2 of FIG. 7 may first verify data trap conditions in order to ensure that the engine data corresponds to normal operating conditions. For example, the method 164 may verify whether the engine speed is greater than or equal to a minimum predefined engine idle speed, excluding start-up and cranking stages of operation. The method 164 may also verify whether the engine 100 is operating at a minimum predefined engine operating temperature to determine whether the engine 100 is ready for data acquisition. For example, if the engine operating temperature meets or exceeds the minimum predefined engine operating temperature, the method 164 may deem the engine 100 as operating in a warm state and under ideal conditions for data acquisition. If, however, the engine operating temperature does not meet the minimum predefined engine operating temperature, the method 164 may deem the engine 100 as operating in a cold state and not yet ready for data acquisition.

In block 164-2 of FIG. 7, the minimum predefined engine operating temperature may be derived by engine oil temperatures, coolant temperatures, or any other temperature indicative of whether the engine 100 is operating in a warm state or a cold state. Although engines vary in terms of operating temperature ranges, a given engine 100 for example may be considered to be in a sufficiently warm state if the engine oil temperature is greater than or equal to approximately 45° C. If any one of the data trap conditions have not been satisfied, the method 164 may continue to receive engine data as in block 164-1 until such conditions have been verified. If, however, all data trap conditions have been verified, the method 164 may proceed to perform calculations and other analyses. Although only two data trap conditions are employed in the method 164 of FIG. 7, it will be understood that different data trap conditions may be employed for different applications or engine types.

Once all data trap conditions have been satisfied per block 164-2, the method 164 in block 164-3 of FIG. 7 may perform calculations on the engine data to determine or derive further information that can be used to characterize the health of the spark plugs or to determine any failures. For example, the method 164 may determine or derive at least the misfire count, deviations in the secondary transformer voltage, deviations in the exhaust port temperature, and any other information potentially relevant to spark plug failures. Based on the misfire count, deviations in the secondary transformer voltage, and deviations in the exhaust port temperature, the method 164 in block 164-4 may identify whether a fault condition exists and what the specific fault condition is. For instance, the method 164 may be able to identify whether a detected fault condition relates to erosion of the metal tip 120 of the spark plug 114, delamination of the metal tip 120, or detachment of the metal tip 120.

Furthermore, based on any identified fault conditions in block 164-4, the method 164 in block 164-5 of FIG. 7 may perform one or more corrective actions that are responsive to any identified fault condition. Moreover, the method 164 may determine the urgency in the detected failure, and provide different degrees of corrective actions based on the urgency. For example, if the fault condition is not a critical one, the method 164 may provide an advisory warning indicating to the operator that one or more of the spark plugs 114 should be replaced at the next available stop or opportunity. If, however, the fault condition is potentially damaging to the engine 100 and in need of immediate attention, the method 164 may stop the engine 100 and provide a more critical warning requiring immediate replacement of the spark plug 114 before continuing operation.

Figure 8:
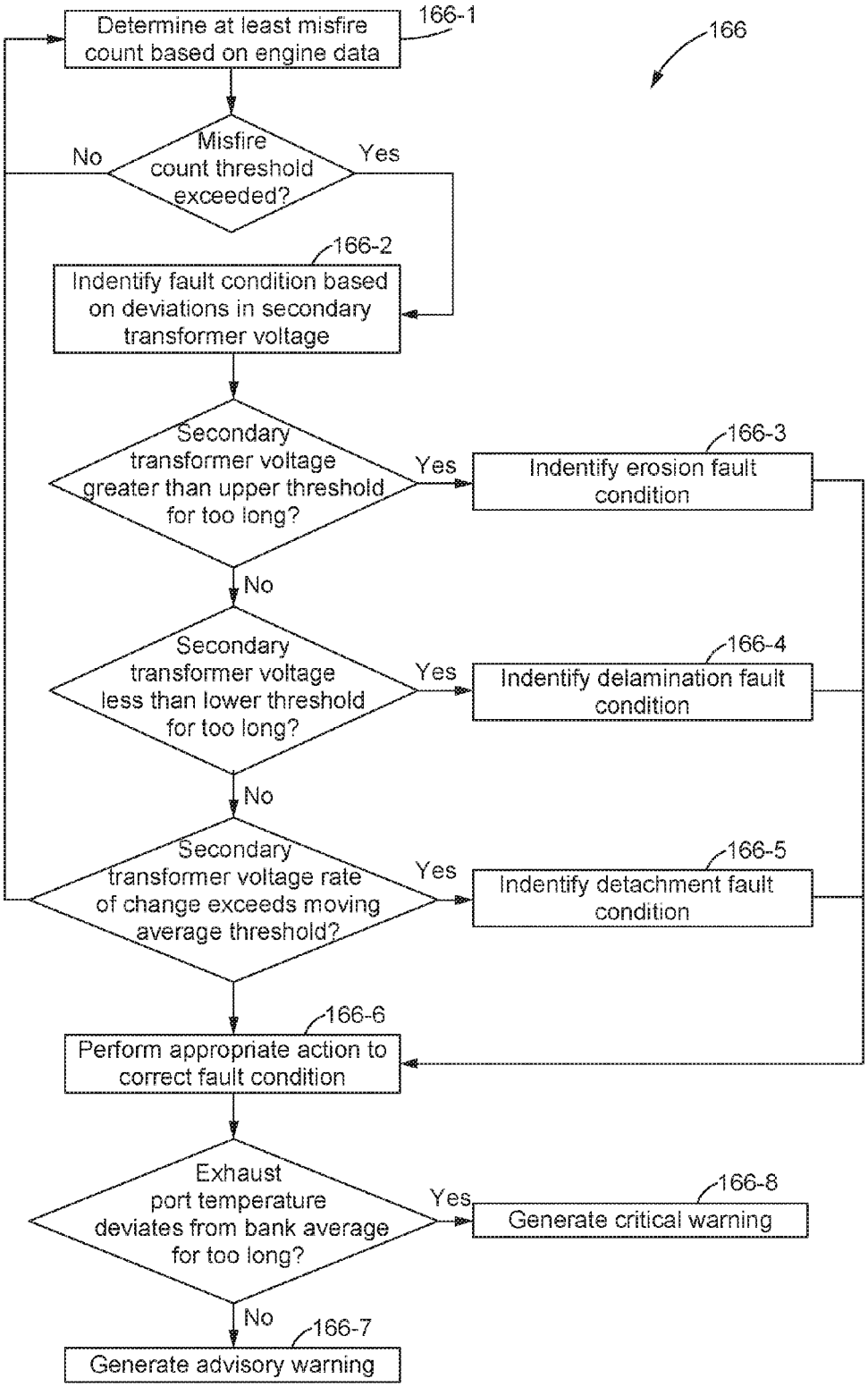
FIG. 8 is a flow diagram of one exemplary scheme or method of identifying spark plug failures in an engine.

Turning now to FIG. 8, one exemplary embodiment of the fault identification scheme or method 166, or blocks 164-3, 164-4 and 164-5 of FIG. 7, is provided. As shown, the method 166 in block 166-1 of FIG. 8 may determine at least a misfire count based on the engine data to first determine if there even is a faulty spark plug 114 or related fault condition. For example, if the misfire count indicates less than 55 detected misfires within a 30-minute duration, the method 166 may deem that no fault condition exists and continue receiving and monitoring engine data according to FIG. 7. If, however, the misfire count indicates approximately 55 or more misfires within a 30-minute duration, the method 166 may confirm that a fault condition exists, and continue to classify or identify the specific fault condition involved.

As shown in block 166-2 of FIG. 8, and as discussed with respect to the fault detection module 150 of FIG. 3, the method 166 may analyze the secondary transformer voltage in order to identify the type of fault condition involved. For example, if the secondary transformer voltage is approximately 95% or more of its maximum value for 5 seconds or longer, or approximately 99% or more for 2 seconds or longer, the method 166 in block 166-3 may identify the fault condition as an erosion-based fault condition. Alternatively, if the secondary transformer voltage is approximately 45% or less of its maximum value for 3 seconds or longer, the method 166 in block 166-4 may identify the fault condition as a delamination-based fault condition. Still further, if the rate of change of the secondary transformer voltage exceeds a moving average threshold, for example, approximately 2.5 V/s within a 10-second period, the method 166 in block 166-5 may identify the fault condition as a detachment-based fault condition.

Once the fault condition has been identified, the method 166 in block 166-6 of FIG. 8 may perform an appropriate corrective action, such as discussed with respect to correction module 152 and the notification module 154 of FIG. 3. Specifically, the corrective action may be selected based on deviations between the exhaust port temperature of the faulty cylinder and the bank average, or the average of the exhaust port temperatures of the other cylinders in the engine 100. For example, if the exhaust port temperature of the faulty cylinder remains within approximately 60° C. of the bank average during a one-hour period, the corrective action may indicate an advisory warning to operators suggesting replacement of the failed spark plug 114 at the next stop or the next available opportunity as shown in block 166-7. If, however, the temperature deviation is in excess of approximately 60° C. during a one-hour period, the responsive corrective action may be to immediately stop the engine 100 and indicate a critical warning to operators suggesting immediate replacement of the failed spark plug 114 as shown in block 166-8.

Furthermore, the algorithms or methods 164, 166 of FIGS. 7 and 8 may be configured to reiteratively perform at frequencies sufficient to characterize the health or any failures of the spark plugs 114. In one possible implementation, the sampling frequency may be designated to be as fast as one crank angle of the engine 100, such as approximately 18 kHz for industrial work machine applications or approximately 50 kHz for automobile or other applications. Moreover, the tasks or processes of the methods 164, 166 described above may be performed at a rate of approximately 1 Hz or approximately once a minute with the engine data being received in streaming formats, in continuous feed formats, in batch formats, or any combination thereof. It will be understood that other suitable sampling or data processing frequencies may also be used for various other applications and still provide comparable results.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A system for detecting spark plug failures in an engine, comprising:

one or more sensor devices coupled to the engine and configured to measure engine data;

a controller in communication with the sensor devices and configured to determine at least a misfire count, a secondary transformer voltage, and an exhaust port temperature based on the engine data, identify a fault condition based on one or more of the misfire count, the secondary transformer voltage, and the exhaust port temperature, and perform a corrective action responsive to the fault condition, wherein the controller is configured to identify the fault condition as one of an erosion-based fault condition, a delamination-based fault condition, and a detachment-based fault condition based on at least the secondary transformer voltage and a minimum misfire count, the erosion-based fault condition being identified if the secondary transformer voltage remains greater than an upper voltage threshold for a first predefined duration, the delamination-based fault condition being identified if the secondary transformer voltage remains less than a lower voltage threshold for a second predefined duration, and the detachment-based fault condition being identified if a rate of change of the secondary transformer voltage with respect to time exceeds a moving average voltage threshold; and an output device configured to generate a notification corresponding to the fault condition.

2. The system of claim 1, wherein the sensor devices are configured to measure engine data corresponding to one or more of engine speed, engine oil temperature, turbine inlet temperature, turbine exhaust temperature, the misfire count, the secondary transformer voltage, the exhaust port temperature, and in-cylinder pressure.

3. The system of claim 1, wherein the controller is configured to determine the misfire count, the secondary transformer voltage, and the exhaust port temperature once one or more data trap conditions have been verified, the data trap conditions including maintaining a minimum predefined engine idle speed and a minimum predefined engine operating temperature, wherein if any one of the data trap conditions have not been satisfied, the controller may continue to receive engine data until such conditions have been verified.

4. The system of claim 1, wherein the controller is configured to perform one of the corrective actions of indicating an advisory warning to replace a failed spark plug at a next stop of the engine, and stopping the engine and indicating a critical warning to replace the failed spark plug, the critical warning being indicated in response to fault conditions where the exhaust port temperature deviates from a bank average temperature in excess of acceptable deviation thresholds for a prolonged duration, and the advisory warning being indicated in response to all other fault conditions.

5. The system of claim 1, wherein the output device includes a display configured to display the notification corresponding to the fault condition to an operator.

6. A controller for detecting spark plug failures in an engine, comprising:

a sensor module configured to receive engine data from one or more sensor devices of the engine;

a calculation module configured to determine at least a misfire count, a secondary transformer voltage, and an exhaust port temperature based on the engine data;

a fault detection module configured to identify a fault condition based on one or more of the misfire count, the secondary transformer voltage, and the exhaust port temperature, wherein the fault detection module is configured to identify the fault condition as one of an erosion-based fault condition, a delamination-based fault condition, and a detachment-based fault condition based on at least the secondary transformer voltage and a minimum misfire count, the erosion-based fault condition being identified if the secondary transformer voltage remains greater than an upper voltage threshold for a first predefined duration, the delamination-based fault condition being identified if the secondary transformer voltage remains less than a lower voltage threshold for a second predefined duration, and the detachment-based fault condition being identified if a rate of change of the secondary transformer voltage with respect to time exceeds a moving average voltage threshold; and a correction module configured to perform a corrective action responsive to the fault condition.

7. The controller of claim 6, wherein the sensor module is configured to receive engine data corresponding to one or more of an engine speed, an engine oil temperature, a turbine inlet temperature, a turbine exhaust temperature, the misfire count, the secondary transformer voltage, the exhaust port temperature, and in-cylinder pressure.

8. The controller of claim 6, wherein the calculation module is configured to determine the misfire count, the secondary transformer voltage, and the exhaust port temperature once one or more data trap conditions have been verified, the data trap conditions including maintaining a minimum predefined engine idle speed and a minimum predefined engine operating temperature, wherein if any one of the data trap conditions have not been satisfied, the controller may continue to receive engine data until such conditions have been verified.

9. The controller of claim 6, wherein the correction module is configured to perform one of the corrective actions of indicating an advisory warning to replace a failed spark, and stopping the engine and indicating a critical warning to replace the failed spark plug, the critical warning being indicated in response to fault conditions where the exhaust port temperature deviates from a bank average temperature in excess of acceptable deviation thresholds for a prolonged duration, and the advisory warning being indicated in response to all other fault conditions.

10. The controller of claim 6, further comprising a notification module configured to display a notification corresponding to the fault condition to an operator through an output device.

11. A method of detecting spark plug failures in an engine, comprising:

receiving engine data from one or more sensor devices of the engine;

determining at least a misfire count, a secondary transformer voltage, and an exhaust port temperature based on the engine data;

identifying a fault condition based on one or more of the misfire count, the secondary transformer voltage, and the exhaust port temperature, wherein the fault condition is identified as one of an erosion-based fault condition, a delamination-based fault condition, and a detachment-based fault condition based on at least the secondary transformer voltage and a minimum misfire count, and wherein the erosion-based fault condition is identified if the secondary transformer voltage remains greater than an upper voltage threshold for a first predefined duration, the delamination-based fault condition is identified if the secondary transformer voltage remains less than a lower voltage threshold for a second predefined duration, and the detachment-based fault condition is identified if a rate of change of the secondary transformer voltage with respect to time exceeds a moving average voltage threshold; and performing a corrective action responsive to the fault condition.

12. The method of claim 11, wherein the engine data correspond to one or more of an engine speed, an engine oil temperature, a turbine inlet temperature, a turbine exhaust temperature, the misfire count, the secondary transformer voltage, the exhaust port temperature, and in-cylinder pressure.

13. The method of claim 11, wherein the misfire count, the secondary transformer voltage, and the exhaust port temperature are determined once one or more data trap conditions have been verified, the data trap conditions including maintaining a minimum predefined engine idle speed and a minimum predefined engine operating temperature, wherein if any one of the data trap conditions have not been satisfied, the one or more sensor devices may continue to receive engine data until such conditions have been verified.

14. The method of claim 11, wherein the corrective actions include one of indicating an advisory warning to replace a failed spark plug, and stopping the engine and indicating a critical warning to replace the failed spark plug.

15. The method of claim 14, wherein the critical warning is indicated in response to fault conditions where the exhaust port temperature deviates from a bank average temperature in excess of a deviation thresholds, and the advisory warning is indicated in response to all other fault conditions.

16. The method of claim 11, further comprising generating a notification corresponding to the fault condition at an output device.

* * * * *